US012398918B2

(12) United States Patent
Feng et al.

(10) Patent No.: US 12,398,918 B2
(45) Date of Patent: Aug. 26, 2025

(54) PORTABLE WATER HEATER

(71) Applicant: ZHONGSHAN POWTEK APPLIANCES MFG., LTD., Zhongshan (CN)

(72) Inventors: Xianwei Feng, Zhongshan (CN); Qi Yang, Zhongshan (CN); Zhiyuan Ma, Zhongshan (CN); Deqing Chen, Zhongshan (CN)

(73) Assignee: ZHONGSHAN POWTEK APPLIANCES MFG., LTD., Zhongshan (CN)

( * ) Notice: Subject to any disclaimer, the term of this patent is extended or adjusted under 35 U.S.C. 154(b) by 60 days.

(21) Appl. No.: 18/506,056

(22) Filed: Nov. 9, 2023

(65) Prior Publication Data

US 2024/0077229 A1 Mar. 7, 2024

Related U.S. Application Data

(63) Continuation of application No. PCT/CN2023/120948, filed on Sep. 25, 2023.

(30) Foreign Application Priority Data

Aug. 16, 2023 (CN) ..... 202322201067.9

(51) Int. Cl.
*F24H 1/06* (2022.01)
*F23J 11/00* (2006.01)
(Continued)

(52) U.S. Cl.
CPC ..... *F24H 1/06* (2013.01); *F23J 11/00* (2013.01); *F23J 13/08* (2013.01); *F23L 17/02* (2013.01);
(Continued)

(58) Field of Classification Search
CPC ..... F24H 9/0031; F24H 1/06; F24H 9/2042; F24H 9/02; F24H 1/0027; F24H 15/31;
(Continued)

(56) References Cited

U.S. PATENT DOCUMENTS 3,494,599 A * 2/1970 Jones ..... F23D 11/10 431/88
2019/0056146 A1* 2/2019 Oliveira ..... F24H 9/2035

FOREIGN PATENT DOCUMENTS

CA 3013142 A1 * 2/2019 ..... F24D 19/1051
CN 202648154 U 1/2013
(Continued)

OTHER PUBLICATIONS

Go_RV_review_aquaheat_lithium_gas_shower_2022.pdf (Year: 2022).*
(Continued)

*Primary Examiner* — Steven S Anderson, II
*Assistant Examiner* — Kurt Wolford

(57) ABSTRACT

A portable water heater includes an inner bracket and a thermostatic chamber. A burner and a heat exchanger are arranged in the inner bracket. An upper end of the heat exchanger is provided with a fume collecting hood. The burner includes multiple fire rows arranged side by side, and the fire rows are connected to each other through a gas-distributing rod. The gas-distributing rod is provided with a segmented self-priming valve. A gas-regulating valve is provided on a gas inlet pipe. An inlet end of an internal heat-exchanging pipe of the heat exchanger is communicated with a cold water feeding pipe. The thermostatic chamber has a water inlet connected to a hot water delivering pipe and a water outlet connected to a hot water discharging pipe, and a connecting pipe is provided between the cold water feeding pipe and the hot water delivering pipe.

9 Claims, 10 Drawing Sheets

(51) Int. Cl.

| | |
|---|---|
| ***F23J 13/08*** | (2006.01) |
| ***F23L 17/02*** | (2006.01) |
| ***F24H 1/00*** | (2022.01) |
| ***F24H 9/00*** | (2022.01) |
| ***F24H 9/02*** | (2006.01) |
| ***F24H 9/20*** | (2022.01) |
| ***F24H 15/215*** | (2022.01) |
| ***F24H 15/219*** | (2022.01) |
| ***F24H 15/238*** | (2022.01) |
| ***F24H 15/31*** | (2022.01) |
| ***F24H 15/365*** | (2022.01) |

(52) U.S. Cl.
CPC ..... *F24H 1/0027* (2013.01); *F24H 9/0031* (2013.01); *F24H 9/2042* (2013.01); *F24H 15/238* (2022.01); *F24H 15/31* (2022.01); *F24H 15/365* (2022.01); *F24H 9/02* (2013.01); *F24H 9/2035* (2013.01); *F24H 15/215* (2022.01); *F24H 15/219* (2022.01)

(58) Field of Classification Search
CPC .... F24H 15/365; F24H 9/2035; F24H 15/215; F24H 15/219; F24H 15/238; F23J 13/08; F23J 11/00; F23L 17/02
See application file for complete search history.

(56) References Cited

FOREIGN PATENT DOCUMENTS

| | | | | | |
|---|---|---|---|---|---|
| CN | 203949369 | U | | 11/2014 | |
| CN | 207035457 | U | | 2/2018 | |
| CN | 208186394 | U | * | 12/2018 | |
| CN | 208936517 | U | | 6/2019 | |
| CN | 110332696 | A | * | 10/2019 | ..... F23J 11/00 |
| CN | 209689198 | U | * | 11/2019 | |
| CN | 111912092 | A | * | 11/2020 | ..... F04B 49/06 |
| CN | 213687267 | U | | 7/2021 | |
| CN | 113983691 | A | | 1/2022 | |
| CN | 218722248 | U | | 3/2023 | |
| JP | H10232054 | A | | 9/1998 | |

OTHER PUBLICATIONS

CN-110332696-A translation (Year: 2019).*
CN-111912092-A translation (Year: 2020).*
CN-208186394-U translation (Year: 2018).*
CN-209689198-U translation (Year: 2019).*

* cited by examiner

PORTABLE WATER HEATER

CROSS-REFERENCE TO RELATED APPLICATIONS

This application is a continuation of International Patent Application No. PCT/CN2023/120948, filed on Sep. 25, 2023, which claims the benefit of priority from Chinese Patent Application No. 202322201067.9, filed on Aug. 16, 2023. The content of the aforementioned applications, including any intervening amendments thereto, are incorporated herein by reference.

TECHNICAL FIELD

This application relates to water heaters, and more particularly to a portable water heater for outdoor activities.

BACKGROUND

Water heater is a common household appliance in daily life, and with the popularization of outdoor sports, portable water heaters have emerged. The existing portable water heaters are mostly gas water heaters, in which a burner is arranged, and the burner generally has multiple fire rows. However, the fire rows in the existing portable water heaters can only be turned on or off at the same time, and cannot be controlled segmentedly, which leads to a large minimum load, thus failing to produce suitable warm water when the water inlet temperature is high in summer. Moreover, the water outlet temperature is prone to be unstable when the gas inlet pressure is not stable. In addition, due to limitations of the valve body, the existing portable water heaters cannot automatically keep the temperature constant, so the water flow and fire intensity need to be manually adjusted. For outdoor application, in the initial restart stage after a shutdown, the output water will be too hot first and then be too cold to be used, resulting in waste of water resources. For wild camping activities, water saving is particularly important, and the extremely hot water may increase the risk of scalding. Therefore, it is necessary to improve the existing portable water heaters.

SUMMARY

An objective of the present disclosure is to provide a portable water heater to solve at least the following technical problems in the prior art:

(1) the existing outdoor portable water heaters cannot automatically keep the water temperature constant; the water temperature is unstable, and may be excessively high in summer; and the outlet water temperature is prone to fluctuation when there is fluctuation in the inlet water temperature or water flow; and (2) the water remaining in the pipelines will render the initial water temperature unstable after restarted, and excessively high outlet water temperature may increase the risk of scalding.

Technical solutions of this application are described as follows.

This application provides a portable water heater, comprising:

an inner bracket;

a controller; and a thermostatic chamber;

wherein a burner and a heat exchanger are arranged in the inner bracket; an upper end of the heat exchanger is provided with a fume collecting hood; the burner comprises a plurality of fire rows arranged side by side; the plurality of fire rows are connected to each other through a gas distributing rod; the gas distributing rod is provided with a segmented self-priming valve and an inlet connector connected to a gas inlet pipe; a gas-regulating valve is provided on the gas inlet pipe; and an end of the gas inlet pipe is connected with a portable gas cylinder;

the controller is electrically connected with the segmented self-priming valve and the gas-regulating valve; a water inlet end of an internal heat-exchanging pipe of the heat exchanger is communicated with a cold water feeding pipe; an outer side of the heat exchanger is provided with a hot water delivering pipe connected to an outlet end of the internal heat-exchanging pipe; and the thermostatic chamber is provided with a water inlet connected to the hot water delivering pipe and a water outlet connected to a hot water discharging pipe; and a connecting pipe is provided between the cold water feeding pipe and the hot water delivering pipe.

In an embodiment, the segmented self-priming valve is a pulse self-priming valve.

In an embodiment, a water flow sensor is provided on the cold water feeding pipe, and is electrically connected to the controller.

In an embodiment, the outdoor portable water heater further comprises:

an anti-tipping switch;

a temperature regulator;

an inlet water temperature probe; and an outlet water temperature probe;

wherein the anti-tipping switch is electrically connected to the controller; the inlet water temperature probe is provided on the cold water feeding pipe, and the outlet water temperature probe is provided on the hot water discharging pipe; and the temperature regulator, the inlet water temperature probe, and the outlet water temperature probe are all electrically connected to the controller.

In an embodiment, two sides of the inner bracket are each screwedly provided with a side panel; a front side of the inner bracket is provided with a front panel, and a back side of the inner bracket is provided with an air-inlet rear cover; a top of the inner bracket is provided with a top cover; two sides of a lower end of the top cover are each screwedly connected with an upper air-inlet grille; a lower side of the inner bracket is provided with a base, and two sides of an upper end of the base are each screwedly connected with a lower air-inlet grille; the side panel is provided with a plurality of slots; and the front panel, the air-inlet rear cover, the upper air-inlet grille, and the lower air-inlet grille are each provided with a clamping plate on a side towards the inner bracket, and the clamping plate is configured to be inserted into a corresponding one of the plurality of slots for clamping connection.

In an embodiment, two sides of the fume collecting hood are each provided with a support plate protruding horizontally; and the lower end of the top cover is screwedly connected to the support plate.

In an embodiment, an end of the connecting pipe is connected to an end of the cold water feeding pipe near the heat exchanger; a cold water discharging pipe is provided side by side on a side of the hot water discharging pipe, and is communicated with the cold water feeding pipe; and the thermostatic chamber is arranged on a side of the heat exchanger, and is located on an upper side of the hot water discharging pipe.

In an embodiment, the fume collecting hood comprises a hood body; the hood body comprises a top plate and two side plates respectively located on two sides of the top plate; a rotatable wind-guide plate is transversely provided inside the hood body; two ends of the rotatable wind-guide plate are each provided with a rotating lug; each of the two side plates is provided with a rotating shaft seat; and the rotating shaft seat is provided with a rotating shaft transversely and inwardly extending from the rotating shaft seat to be insertedly connected with the rotating lug.

In an embodiment, an upper side of a middle portion of the rotatable wind-guide plate is provided with an upper baffle connected to the top plate; a lower end of each of the two side plates is provided with a flanging portion extending inwardly; a support plate assembly is connected between two flanging portions; and two ends of the support plate assembly are each provided with an extension portion which is configured to be supported on an upper side of a corresponding one of the two flanging portions.

In an embodiment, a middle of each of the two flanging portion is provided with a limit plate extending downwardly; and the support plate assembly is configured to abut against two limit plates to form a rectangular mounting structure.

Compared with the prior art, this application has the following beneficial effects.

(1) By adding a segmented self-priming valve on the gas distributing rod, the turning off/on of all or part of the fire rows in the burner can be controlled, with a lower load. At the same time, by installing the gas regulating valve, the intake pressure fluctuates within a certain range without affecting the back pressure of the valve to make the combustion stable, thereby avoiding the unstable temperature of the outlet water. In the meanwhile, the back pressure of the valve body can be adjusted to be lower to control the opening of part of the fire rows in cooperation with the segmented self-priming valve. In this case, the output power of the water heater provided herein is lower than that of the general water heater. Moreover, it also solves the problems in the commonly used water-gas linkage valves, such as a high small load and a high water temperature in summer. In addition, the pulse self-priming valve is a pulse control valve switch, so that the voltage is not required to be maintained, which is energy-saving and environmentally friendly.

(2) A thermostatic chamber is introduced herein, such that the water in the thermostatic chamber can mix with newly generated high-temperature hot water and the entrained water that is not heated to the set temperature during the start-up of the water heater, so as to minimize fluctuations in the outlet temperature, thereby solving the problem of unstable temperature of the outlet water when the water heater stops and starts.

(3) The wind-guide plate is arranged on the fume collecting hood using a connection structure between the rotating lug and the rotating shaft, simplifying the installation of the wind-guide plate and rendering the wind-guide plate a small rotation resistance. The wind-guide plate can meet the standard blowing test and has a high stability. Moreover, the combination of the support plate and the limit plate can form a rectangular mounting structure.

(4) The internal bracket provided inside the water heater can protect the core components. The external shell of the water heater is assembled using buckling structures and is under the stress of the internal support. The installation and disassembly of the external shell are relatively simple, with less screw connection and a beautiful appearance.

DETAILED DESCRIPTION OF EMBODIMENTS

The technical solutions of the present disclosure will be described clearly and completely below in conjunction with the accompany drawings of the present disclosure. It is obvious that described herein are only some embodiments of the present disclosure, instead of all embodiments of the disclosure.

Figure 1:
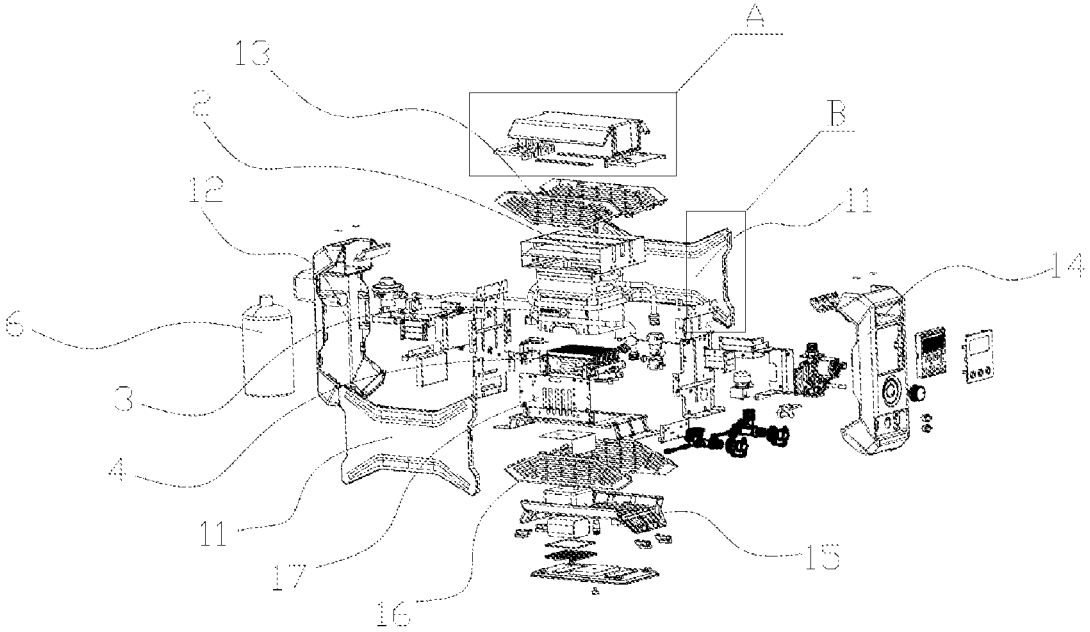
FIG. 1 is an integral exploded view of a portable water heater according to an embodiment of the present disclosure.
Figure 2:
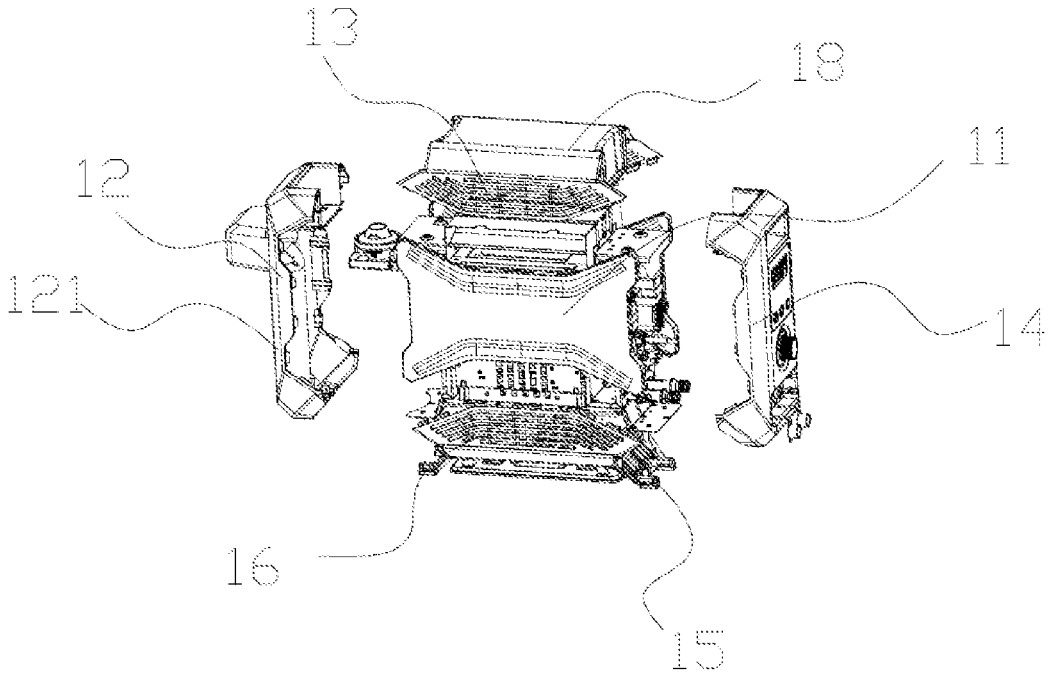
FIG. 2 is a local exploded view of the portable water heater according to an embodiment of the present disclosure.
Figure 3:
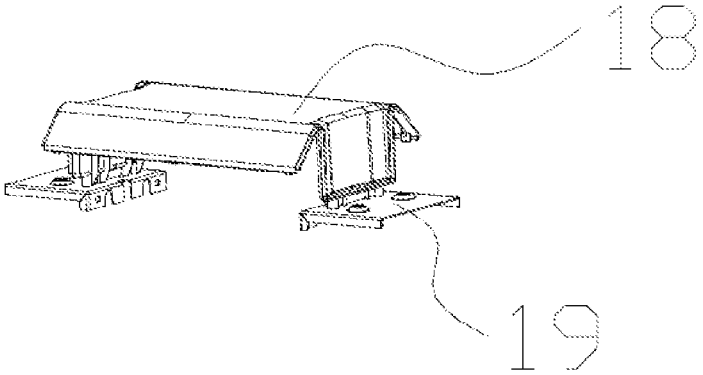
FIG. 3 is an enlarged view of portion A of FIG. 1.
Figure 4:
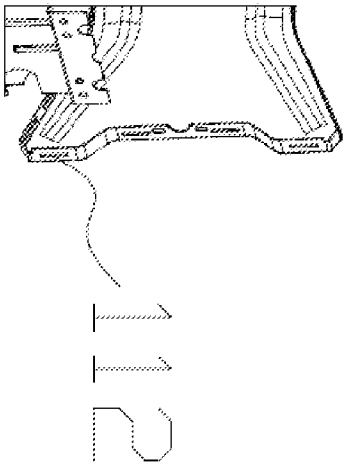
FIG. 4 is an enlarged view portion B of FIG. 1.
Figure 5:
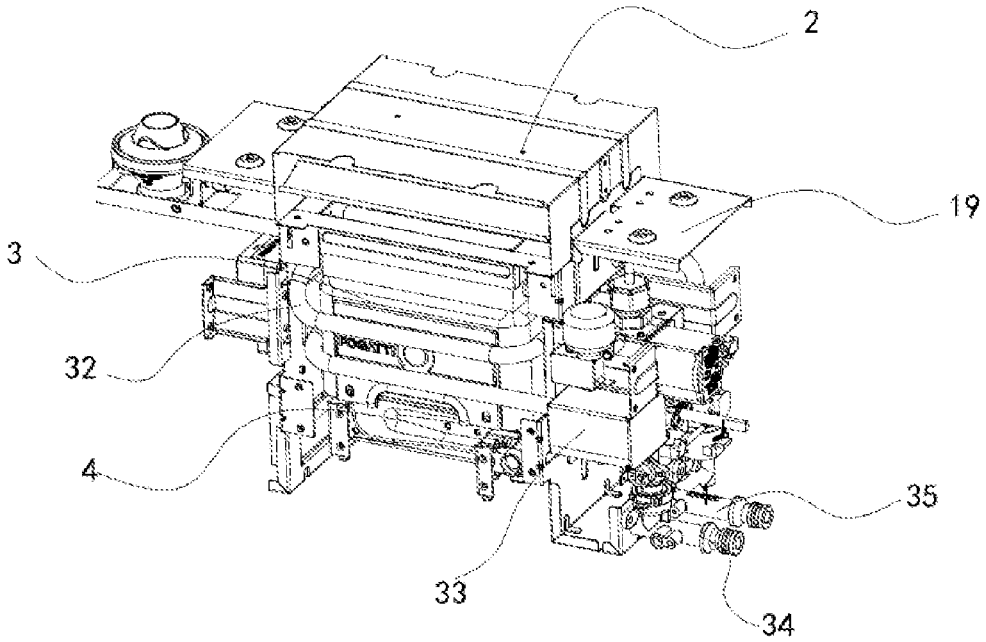
FIG. 5 is a perspective view of an interior of the portable water heater according to an embodiment of the present disclosure.
Figure 6:
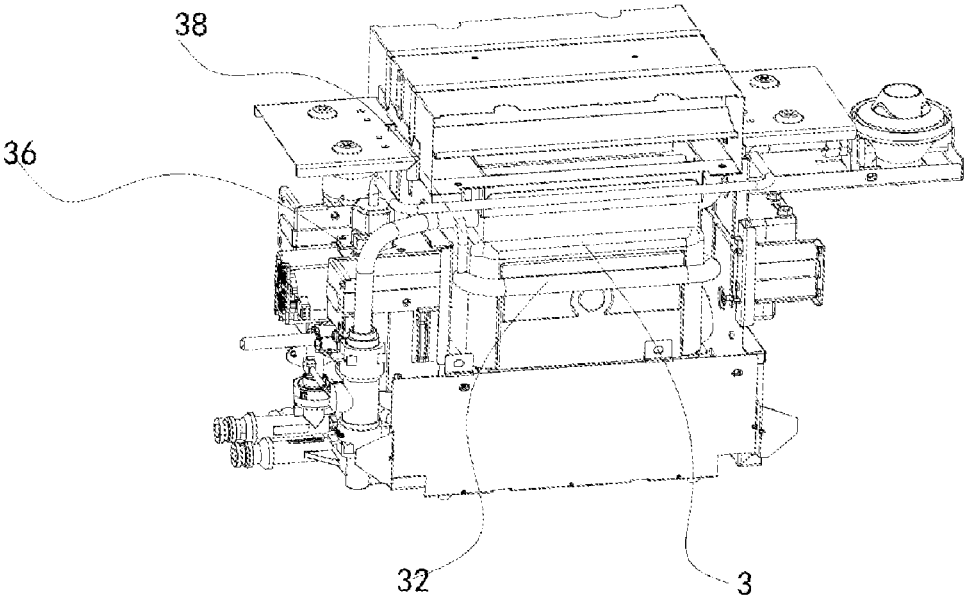
FIG. 6 is another perspective view of the interior of the portable water heater according to an embodiment of the present disclosure.
Figure 7:
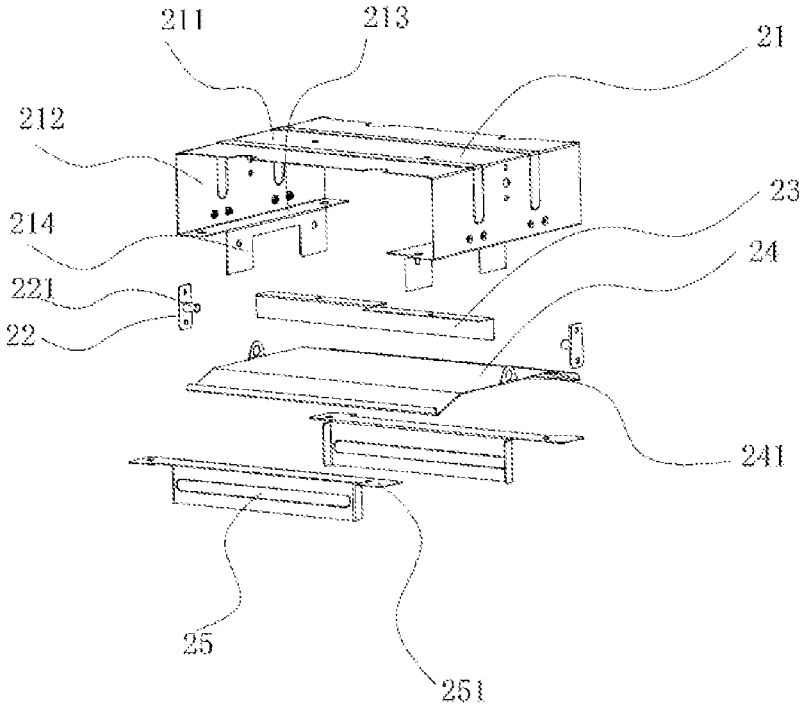
FIG. 7 is an exploded view of a fume collecting hood according to an embodiment of the present disclosure.
Figure 8:
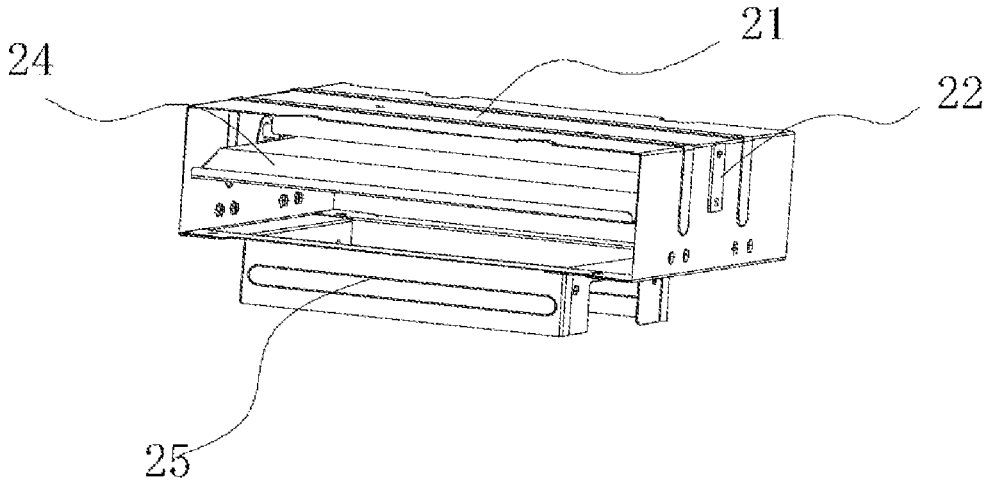
FIG. 8 is a 3D structural diagram of the fume collecting hood according to an embodiment of the present disclosure.
Figure 9:
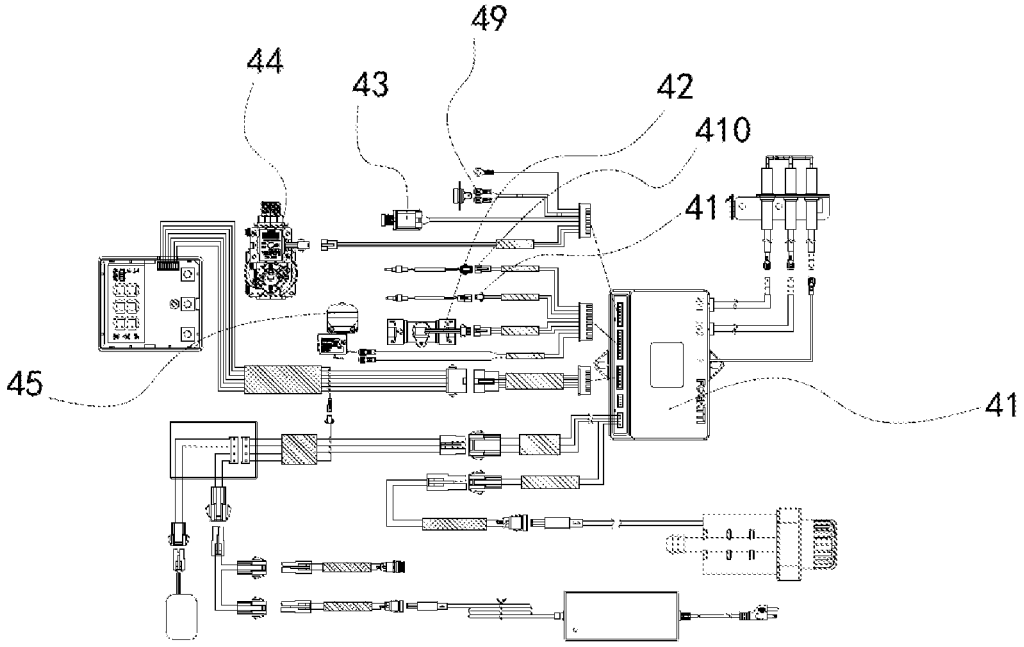
FIG. 9 shows electrical connections in the portable water heater according to an embodiment of the present disclosure.
Figure 10:
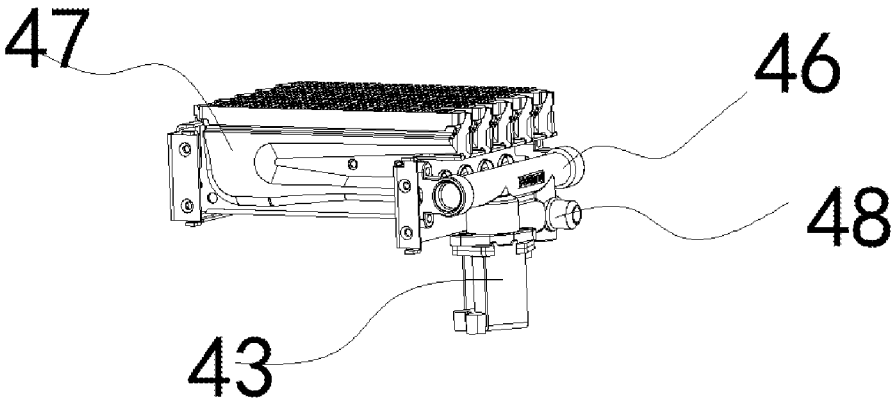
FIG. 10 is a 3D structural diagram of a burner according to an embodiment of the present disclosure.

As shown in FIGS. 1-10, this application provides a portable water heater for outdoor activities, which includes an inner bracket 17. A burner 4 and a heat exchanger 3 are arranged in the inner bracket 17. An upper end of the heat exchanger 3 is provided with a fume collecting hood 2. The burner 4 includes a plurality of fire rows 47 arranged side by side. The plurality of fire rows 47 are connected to each other through a gas distributing rod 46. The gas distributing rod 46 is provided with a segmented self-priming valve 43 and an inlet connector 48 connected to a gas inlet pipe. A gas-regulating valve 44 is provided on the gas inlet pipe of the water heater. An end of the gas inlet pipe is connected with a portable gas cylinder 6. The water heater is also provided with a controller 41, and the controller 41 is electrically connected with, at least the segmented self-priming valve 43 and the gas-regulating valve 44. A water inlet end of an internal heat-exchanging pipe of the heat exchanger 3 is communicated with a cold water feeding pipe 36. An outer side of the heat exchanger 3 is provided with a hot water delivering pipe 32 connected to an outlet end of the internal heat-exchanging pipe. The water heater is also provided with a thermostatic chamber 33. The thermostatic chamber 33 is provided with a water inlet connected to the hot water delivering pipe 32 and a water outlet connected to a hot water discharging pipe 34. A connecting pipe 38 is provided between the cold water feeding pipe 36 and the hot water delivering pipe 32.

Specifically, the segmented self-priming valve 43 is a pulse self-priming valve. The gas regulating valve can make the inlet air pressure more stable to render a stable combustion, leading to a stable water temperature. In the meanwhile, the back pressure of the segmented self-priming valve 43 can be adjusted to be lower to solve the problems in the commonly used water and gas linkage valve, such as the high small load and the high temperature of the outlet water in the summer. In the meanwhile, a water flow sensor 42 is provided on the cold water feeding pipe of the water heater. The water flow sensor 42 is electrically connected to the controller 41, which can make the starting flow rate lower and adapt to a wider range of water pressure.

In addition, the water heater is also provided with an anti-tipping switch 45 electrically connected to the controller 41, and the anti-tipping switch 45 is configured for anti-tipping protection. The water heater further includes a temperature regulator 49, an inlet water temperature probe 410 provided on the cold water feeding pipe and an outlet water temperature probe 411 provided on the hot water discharging pipe. The temperature regulator 49, the inlet water temperature probe 410, and the outlet water temperature probe 411 are all electrically connected to the controller 41. The inlet water temperature probe 410 and the outlet water temperature probe 411 can monitor the temperature of the inlet cold water and the outlet hot water, respectively. The temperature regulator 49 can protect the water circuit. When the water flow is small, the water temperature is too high, and the temperature regulator 49 prevents the heat exchanger from dry burning.

In this embodiment, as shown in FIGS. 1-4, two sides of the inner bracket 17 are each screwedly provide with a side panel 11. A front side of the inner bracket 17 is provided with a front panel 14, and a back side of the inner bracket 17 is provided with an air-inlet rear cover 12. A top of the inner bracket 7 is provided with a top cover 18. Two sides of a lower end of the top cover 18 are each screwedly connected with an air-inlet rear cover 13. A lower side of the inner bracket 17 is provided with a base 15, and two sides of an upper end of the base 15 are each screwedly connected with a lower air-inlet grille 16. The side panel 11 is provided with a plurality of slots 112.

The front panel 14, the air intake back cover 12, the air-inlet rear cover 13, and the lower air-inlet grille 16 are each provided with a clamping plate 121 on a side towards the inner bracket 17, and the clamping plate 121 is configured to be inserted into a corresponding one of the plurality of slots 112 for clamping connection. Specifically, a housing of the water heater consists of the side panel 11, the upper cover 18, the front panel 14, the air-inlet rear cover 12, the air-inlet rear cover 13 and the lower air-inlet grille 16. The upper cover 18, the front panel 14, the air-inlet rear cover 12, the air-inlet rear cover 13 and the lower air-inlet grille 16 are all spliced with the side panel 11 through the clamping connection between the clamping plate 121 and the slot 112. Therefore, when assembling, the side panel 11 is first fixedly connected to the inner bracket 17 through screws, where the screws are fixed from the inside and are not visible on the outside. After the installation of the side panel 1 is completed, the air-inlet rear cover 13 is fixedly connected to the upper cover 18, and the lower air-inlet grille 16 is fixedly connected to the base 15 in the same way. After that, all the components are assembled and connected to the side panel 11 through the clamping plate 121. Similar operations are performed for disassembling, which is very simple.

To improve the pressure resistance of the upper cover 18, two sides of the fume collecting hood 2 are each provided with a support plate 19 protruding horizontally. The lower end of the top cover 18 is screwedly connected to the support plate 19. The support plate 19 can provide auxiliary support to the top cover 18 to improve the overall strength of the water heater.

To improve the strength of the side panels 11, edges of the side panels 11 are all provided with a folded edge, and the slot 112 is provided on the folded edge. The folded edge is provided with a plurality of screw holes, so that the side panels 11 can be fixedly and screwedly connected to the inner bracket 17.

In this embodiment, an end of the connecting pipe 38 is connected to an end of the cold water feeding pipe 36 near the heat exchanger 3. The cold water discharging pipe is provided side by side on a side of the hot water discharging pipe 34, and is communicated with the cold water feeding pipe 36. The thermostatic chamber 33 is arranged on a side of the heat exchanger 3 and is located on an upper side of the hot water discharging pipe 34. During the use of the water heater, when the water heater is turned off and then restarted, the cold water in the cold water feeding pipe 36 that is not subjected to heat exchange is introduced into the hot water delivering pipe 32 through the connecting pipe 38 to be mixed with the hot water in the hot water delivering pipe 32, and then enters into the thermostatic chamber 33 for mixing with the water in the thermostatic chamber 33 to discharge. The water that is not heated after restarting also enters into the thermostatic chamber 33 to be mixed with the water in the thermostatic chamber 33 for reducing the temperature difference and then is discharged. Therefore, the device can control the temperature difference of the outlet water to a very small amplitude when turned off or turned on, so the outlet water will not very hot or cold, thus avoiding the risk of high-temperature scalding. One end of the connecting pipe 38 is connected to the end of the cold water feeding pipe 36 close to the heat exchanger 3, and the length of the connecting pipe 38 is not required to be very long. The cold water discharging pipe 35 is provided side by side on a side of the hot water discharging pipe 34, and is communicated with the cold water feeding pipe 36. The thermostatic chamber 33 is arranged on a side of the heat exchanger 37 and is located on the upper side of the hot water discharging pipe 34, so that the hot water in the thermostatic chamber 33 can be timely discharged from the hot water discharging pipe 34.

In this embodiment, the fume collecting hood 2 includes a hood body 21. The hood body includes a top plate 211 and two side plates 212 respectively located on two sides of the top plate 211. A rotatable wind-guide plate 24 is transversely provided inside the hood body 21. Tow ends of the rotatable wind-guide plate 24 are each provided with a rotating lug 241. Each of the side plates 212 is provided with a rotating shaft seat 22. The rotating shaft seat 22 is provided with a rotating shaft 221 transversely and inwardly extending from the rotating shaft seat 22 to be insertedly connected with the rotating lug 241. Specifically, the rotatable wind-guide plate 24 is directly hung on the rotating shaft 221 through the rotating lug 241, so the rotatable wind-guide plate 24 is convenient for installation. There is no blocking structure on the surface of the rotatable wind-guide plate 24, which will not affect the rotation of the rotatable wind-guide plate 24. The rotatable wind-guide plate 24 can rotate up and down around the rotating shaft 221. The normal state is the open state, that is, the smoke discharge state, and at this time, the wind-guide plate 24 rotates upwardly. When there is wind blowing to the fume collecting hood from the outside, the windward side of the rotatable wind-guide plate 24 is closed, and the other side is in the open state, which prevents the wind from entering into the fume collecting hood.

In an embodiment, the upper side of the middle portion of the rotatable wind-guide plate 24 is provided with an upper baffle 23 connected to the top plate 211. The lower end of the side plate 212 is provided with a flanging portion 213 extending inwardly. A support plate assembly 25 is connected between two flanging portions 213. Two ends of the support plate assembly 25 are each provided with an extension portion 251 which is configured to be supported on an upper side of a corresponding one of the two flanging portions 213, so that the lower end of the hood body 21 can be supported by the support plate 25, which is convenient for installation and fixing with the heat exchanger.

A middle of each of the two flanging portions 213 is provided with a limit plate 214 extending downwardly, and the support plate assembly 25 abuts against two limit plates 214 to form a rectangular mounting structure. The rectangular mounting structure has great strength to meet the mounting needs. The rotating shaft seat 22 is arranged on the outer side of the side plate 212, and the rotating shaft 221 passes through the side plate 212 to connect with the rotating lug 241.

It is to be noted that all directional indications (such as up, down, left, right, front, and back) used herein are only used to explain the relative positional relationship and movement among the components in a particular attitude (as shown in the attached drawings). If the particular attitude is changed, the directional indication is changed accordingly.

Furthermore, the terms, such as "first" and "second", used herein are only for descriptive purposes and should not be construed as indicating or implying relative importance or implicitly specifying the number of technical features indicated. As a result, a feature defined as "first" or "second" may expressly or implicitly include at least one such feature. In the description of the present disclosure, "plurality" means at least two, e.g., two, three, etc., unless otherwise expressly and specifically limited.

In the present disclosure, unless otherwise expressly provided and limited, the terms, such as "connection" and "fixing", shall be interpreted in a broad sense. For example, "fixing" may refers to a fixed connection, a removable connection, or a one-piece connection, and it may be a mechanical connection or an electrical connection, a direct connection or an indirect connection through an intermediate medium, or a connection within two elements or a relationship between two elements, unless expressly limited otherwise. For one of ordinary skill in the art, the specific meaning of the above terms in the present disclosure can be understood according to the specific circumstances.

In addition, the technical solutions of various embodiments of the present disclosure can be combined with each other on the premise that the combined solution can be achieved by one of ordinary skill in the art. When the combination of technical solutions appears to be contradictory or cannot be implemented by those skilled in the art, it should be considered that such combination does not exist, and is not included in the scope of the present disclosure defined by the appended claims.

What is claimed is:

1. A portable water heater, comprising:

an inner bracket;

a controller; and a thermostatic chamber;

wherein a burner and a heat exchanger are arranged in the inner bracket; an upper end of the heat exchanger is provided with a fume collecting hood; the burner comprises a plurality of fire rows arranged side by side; the plurality of fire rows are connected to each other through a gas distributing rod; the gas distributing rod is provided with a segmented valve and an inlet connector connected to a gas inlet pipe; a gas-regulating valve is provided on the gas inlet pipe; and an end of the gas inlet pipe is connected with a portable gas cylinder;

the controller is electrically connected with the segmented valve and the gas-regulating valve; a water inlet end of an internal heat-exchanging pipe of the heat exchanger is communicated with a cold water feeding pipe; an outer side of the heat exchanger is provided with a hot water delivering pipe connected to an outlet end of the internal heat-exchanging pipe;

the thermostatic chamber is provided with a water inlet connected to the hot water delivering pipe and a water outlet connected to a hot water discharging pipe; and a connecting pipe is provided between the cold water feeding pipe and the hot water delivering pipe; and two sides of the inner bracket are each screwedly provided with a side panel; a front side of the inner bracket is provided with a front panel, and a back side of the inner bracket is provided with an air-inlet rear cover; a top of the inner bracket is provided with a top cover; two sides of a lower end of the top cover are each screwedly connected with an upper air-inlet grille; a lower side of the inner bracket is provided with a base, and two sides of an upper end of the base are each screwedly connected with a lower air-inlet grille; the side panel is provided with a plurality of slots; and the front panel, the air-inlet rear cover, the upper air-inlet grille, and the lower air-inlet grille are each provided with a clamping plate on a side towards the inner bracket, and the clamping plate is configured to be inserted into a corresponding one of the plurality of slots for clamping connection.

2. The portable water heater of claim 1, wherein the segmented valve is a pulse valve.

3. The portable water heater of claim 1, wherein a water flow sensor is provided on the cold water feeding pipe, and is electrically connected to the controller.

4. The portable water heater of claim 1, further comprising:

an anti-tipping switch;

a temperature regulator;

an inlet water temperature probe; and an outlet water temperature probe;

wherein the anti-tipping switch is electrically connected to the controller; the inlet water temperature probe is provided on the cold water feeding pipe, and the outlet water temperature probe is provided on the hot water discharging pipe; and the temperature regulator, the inlet water temperature probe, and the outlet water temperature probe are all electrically connected to the controller.

5. The portable water heater of claim 1, wherein two sides of the fume collecting hood are each provided with a support plate protruding horizontally; and the lower end of the top cover is screwedly connected to the support plate.

6. The portable water heater of claim 1, wherein an end of the connecting pipe is connected to an end of the cold water feeding pipe near the heat exchanger; a cold water discharging pipe is provided side by side on a side of the hot water discharging pipe, and is communicated with the cold water feeding pipe; and the thermostatic chamber is arranged on a side of the heat exchanger, and is located on an upper side of the hot water discharging pipe.

7. The portable water heater of claim 1, wherein the fume collecting hood comprises a hood body; the hood body comprises a top plate and two side plates respectively located on two sides of the top plate; a rotatable wind-guide plate is transversely provided inside the hood body; a first end of the rotatable wind-guide plate is provided with a first rotating lug, and a second end of the rotatable wind-guide plate is provided with a second rotating lug; one of the two side plates is provided with a first rotating shaft seat, and the other of the two side plates is provided with a second rotating shaft seat; and the first rotating shaft seat is provided with a first rotating shaft transversely and inwardly extending from the first rotating shaft seat to be insertedly connected with the first rotating lug, and the second rotating shaft seat is provided with a second rotating shaft transversely and inwardly extending from the second rotating shaft seat to be insertedly connected with the second rotating lug.

8. The portable water heater of claim 7, wherein an upper side of a middle portion of the rotatable wind-guide plate is provided with an upper baffle connected to the top plate; a lower end of each of the two side plates is provided with a flanging portion extending inwardly; a support plate assembly is connected between two flanging portions; and two ends of the support plate assembly are each provided with an extension portion which is configured to be supported on an upper side of a corresponding one of the two flanging portions.

9. The portable water heater of claim 8, wherein a middle of each of the two flanging portion is provided with a limit plate extending downwardly; and the support plate assembly is configured to abut against two limit plates to form a rectangular mounting structure.

* * * * *